United States Patent [19]

Miner et al.

[11] 4,043,270

[45] Aug. 23, 1977

[54] NEEDLEWORK FRAME

[75] Inventors: Antonia V. Miner, Londonderry; Joseph Nichols, Newfane, both of Vt.

[73] Assignee: Toni Totes of Vermont, Inc., South Londonderry, Vt.

[21] Appl. No.: 710,159

[22] Filed: July 30, 1976

[51] Int. Cl.[2] ..... D06C 3/08

[52] U.S. Cl. ..... 38/102.91

[58] Field of Search ..... 38/102–102.91

[56] References Cited

U.S. PATENT DOCUMENTS

| | | | |
|---|---|---|---|
| 3,869,817 | 3/1975 | Bowman | 38/102.4 |
| 3,938,267 | 2/1976 | Bard | 38/102.1 |

*Primary Examiner*—G. V. Larkin

*Attorney, Agent, or Firm*—Cushman, Darby & Cushman

[57] ABSTRACT

An assembly for supporting needlework that is readily convertible from a lap position to a floor position. A needlework frame comprising a pair of side rails and a pair of dowels extending between the side rails and parallel to and spaced from each other, pivotally mounted to a lap stand for supporting the needlework frame so that it is in a convenient workable position for someone sitting in a position with legs outstretched, the lap stand including a pair of distinct support brackets, each support bracket including a base member and a pair of support members extending upwardly from the base member to define, with the base member, a triangularly shaped support bracket. Each of the dowels has a strip of webbing attached thereto and the webbing is adapted to receive needlework to be supported by the needlework frame. The dowels are mounted with respect to the side rails so that the dowels selectively are rotatable with respect to the side rails or non-rotatable with respect to the side rails to either take up the needlework by rotation of the dowels, or to hold the needlework in a firm working position. A floor stand is also provided for supporting the needlework frame so that it is in a convenient workable position for someone in a standing or chair-sitting position, the floor stand comprising a pair of uprights, each upright connected to a base piece, and a spacer connecting the base pieces together. The needlework frame is also pivotally mounted with respect to the floor stand in the same manner as with the lap stand. A particularly positioned set of bolts are provided on the floorstand uprights for mounting all the component parts of the lap stand on the floor stand when the lap stand is not in use for supporting the needlework frame.

9 Claims, 3 Drawing Figures

NEEDLEWORK FRAME

BACKGROUND AND SUMMARY OF THE INVENTION

The invention relates to an assembly for supporting needlework so that it is convenient for an individual to work on the needlework whether the individual assumes a sitting position with legs outstretched (i.e., on a bed), a chair-sitting position, or a standing position. By utilizing the assembly according to the present invention it is possible to work on needlework of widely varying dimensions without utilizing different sized needlework frames, and a compact, convenient assembly is provided for supporting a needlework frame in either of two vertical positions, with a minimum number of component parts being provided.

There have been several prior art proposals for the support of needlework in either of two positions (a lap position or a floor position) utilizing generally the same equipment in each position. For instance, in U.S. Pat. No. 3,938,267 there is disclosed a device for supporting needlework in either a relatively low vertical position (FIGS. 1 and 2) or a relatively high vertical position (FIG. 4), utilizing the same upright support members in each position. The number of component parts provided for the assembly is still quite large, however, since the actual frame for supporting the needlework is different for each position, and a great amount of assembly and disassembly of the component parts must be effected before the device can be converted from one position to another, and there is no ready provision for storing all of the component parts associated with the lap position assembly on the floor position assembly. This is in clear contract to the present invention wherein all of the component parts associated with the lap stand may be mounted on the floor stand (in an unobtrusive position), the same needlework frame is utilized in both positions, changeover between positions is simple and easily effected, and a few component parts are provided. Also, a relatively wide variety of dimensions of needlework may be worked on according to the invention without the need for utilizing different sized needlework frames.

U.S. Pat. No. 3,869,817 discloses another proposed device for utilization as a support for needlework both in lap and floor positions (see FIGS. 1 and 6). While the same needlework frame is utilized for both positions and while relatively few component parts are provided, the structures are not as readily convertible as according to the present invention, there is no provision of storage of the lap stand components with the floor stand components when the lap stand components are not in use, and there is no ready provision for the utilization of the needlework frame needlework with widely varying dimensions.

According to the present invention an assembly is provided for supporting needlework comprising a needlework frame comprising a pair of side rails and a pair of dowels extending between the side rails and parallel to and spaced from each other, a lap standing for supporting the needlework frame so that it is in a convenient workable position for someone in a sitting position with legs outstretched, the lap stand including a pair of distinct support brackets, each support bracket including a base member and a pair of support members extending upwardly from the base member to define, with the base member, a triangularly shaped support bracket, and means for pivotally mounting the needlework frame on the lap stand so that the lap stand supports the needlework frame yet is pivotal with respect thereto. Each of the dowels of the needlework frame preferably has a strip of webbing attached thereto adapted to receive the needlework thereon, and the dowels are mounted with respect to the side rails so that the dowels selectively are rotatable with respect to the side rails or non-rotatable with respect to the side rails to take up the needlework or firmly support it in a working position, respectively. The means for pivotally mounting the needlework frame on the lap stand includes a pivot-post projecting outwardly from each side rail of the needlework frame, and means defining pivot-post receiving slots in each support member of each support bracket, each pivot-post passing through the pivot-post receiving slots in each support member.

According to another aspect of the present invention, as assembly for supporting needlework is provided comprising a needlework frame (the same needlework frame as for the lap stand), a floor stand for supporting the needlework frame so that it is in a convenient workable position for someone in a standing or chair-sitting position, the floor stand comprising a pair of uprights, each upright connected to a base piece, and a spacer operatively connecting the base pieces together, means for pivotally mounting the needlework frame on the floor stand, a lap stand, and means for mounting all the component parts of the lap stand on the floor stand when the lap stand is not in use for supporting the needlework frame. The lap stand includes the distinct support brackets described above, and the means for mounting the lap stand on the floor stand includes a pivot-post projecting outwardly from each upright of the floor stand, and means defining pivot-post receiving slots in each of the support members of each support bracket, each pivot-post passing through the pivot-post receiving slots in each support member, and the pivot-post being mounted a given distance on said uprights spaced from the floor stand base members so that when the pivot-posts are received by the pivot-post receiving slots the lap stand support bracket base members are substantially vertically even with the floor stand base members.

It is the primary object of the present invention to provide a simple effective needlework support assembly for supporting a common needlework frame in either a lap or a floor position, with a minimum number of parts and a maximum cooperation between the parts. This and other objects of the invention will become clear from an inspection of the detailed description of the invention and from the appended claims.

DETAILED DESCRIPTION OF THE INVENTION

Figure 1A:
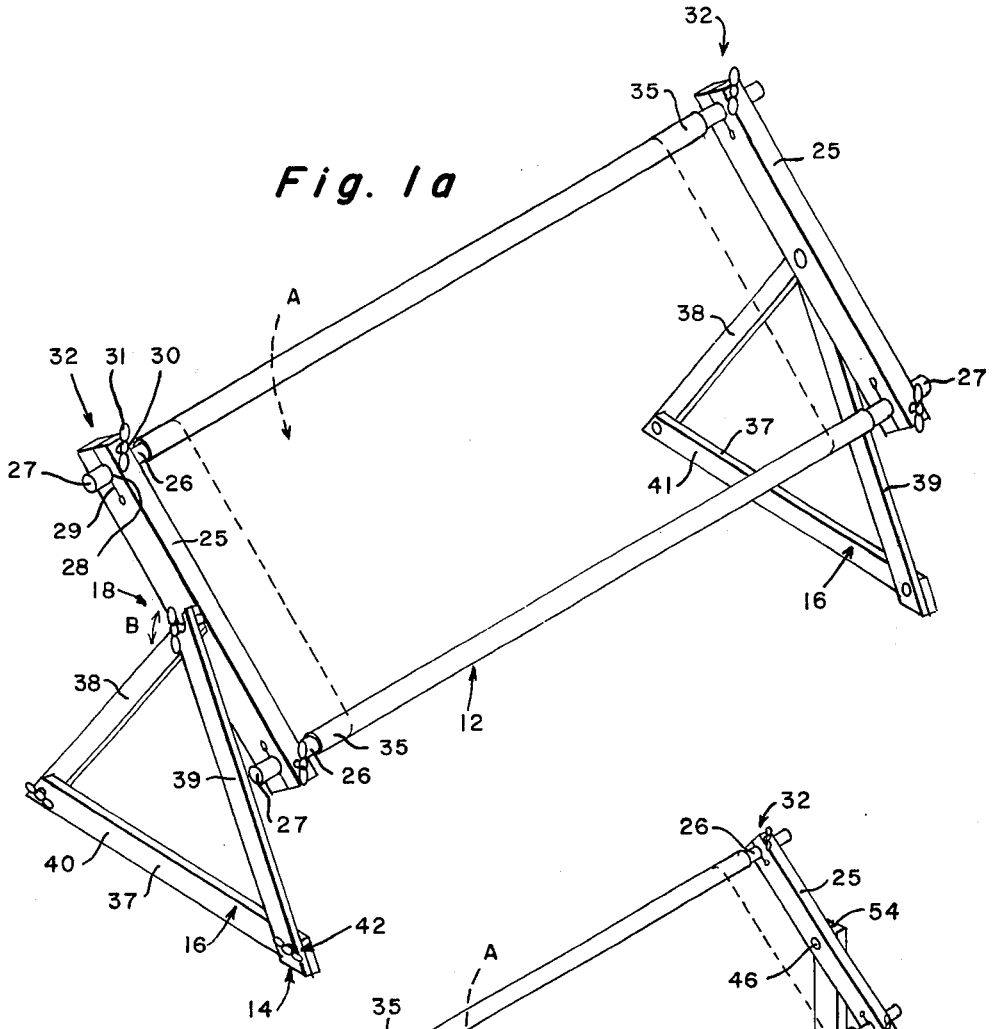
FIG. 1*a* is a perspective view of an exemplary assembly according to the present invention in a lap position.

An assembly according to the present invention for supporting needlework is shown in FIG. 1*a* including a needlework frame 12, a lap stand 14 for supporting the needlework frame 12 so that it is in a convenient workable position for someone in a sitting position without legs outstretched, the lap stand including a pair of distinct support brackets 16, and means 18 for pivotally mounting the needlework frame 12 on the lap stand 14 so that the lap stand supports the needlework frame 12, yet the needlework frame is pivotal with respect thereto.

Figure 2:
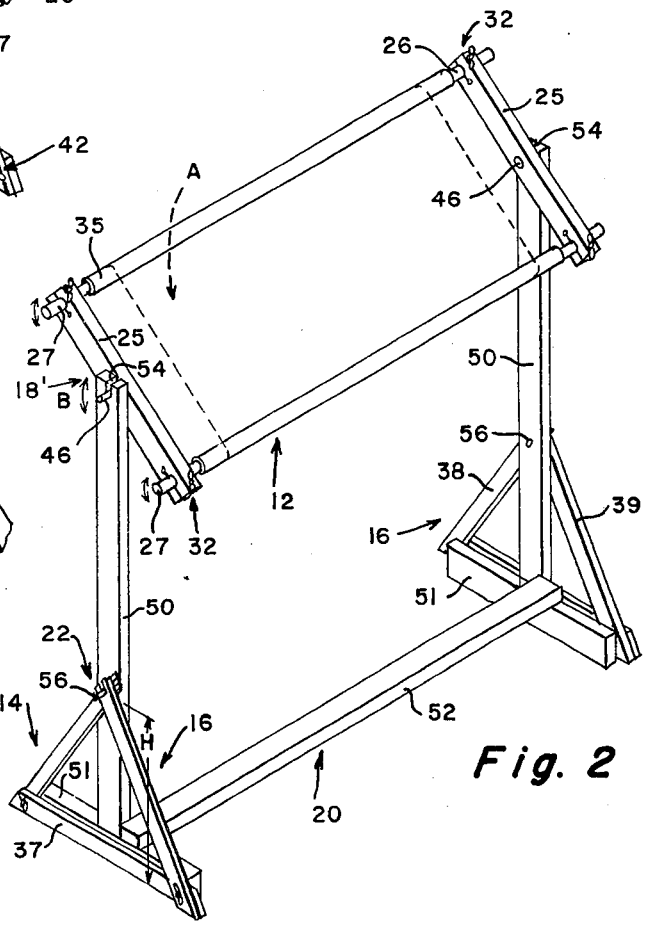
FIG. 2 is a perspective view of an exemplary assembly according to the present invention in a floor position thereof.

According to another aspect of the present invention, as illustrated in FIG. 2, assembly for supporting needlework is provided including a needlework frame 12, a floor stand 20 for supporting the needlework frame 12 so that it is in a convenient workable position for someone in a standing or chair-sitting position, means 18' for pivotally mounting the needlework frame 12 on the floor stand 20, a lap stand 14 for supporting the needlework frame 12 in place of the floor stand 20, and means 22 for mounting all the component parts of the lap stand 14 on the floor stand 20 when the lap stand 14 is not in use for supporting the needlework frame 12.

The needlework frame 12 includes a pair of side rails 25 and a pair of dowels 26 extending between the side rails and parallel to and spaced from each other. A portion 27 of each dowel 26 extends past the side rails 25, the dowels 26 extending through openings 28 formed in the side rails 25. Slots (i.e., ⅛ inch slots) 29 are provided in the ends of the side rails 25 extending perpendicular to the dowels 26 and screws 30 are passed through the end portions of the side rails 25, the bolts 30 in combination with the wing nuts 31 providing tight gripping of the dowels 26 by the side rails 25 to prevent relative rotative movement therebetween. The openings 28, slots 29, bolts 30, and wing nuts 31 in combination comprise means 32 for mounting the dowels 26 of the needlework frame 12 with respect to the side rails 25 so that the dowels 26 selectively are rotatable with respect to the side rails 25 or non-rotatable with respect to side rails 25. When it is desired to hold needlework A in a firm working position, the wing nuts 31 are tightened on to the bolts 30 so that a tight gripping engagement of the dowels 26 is provided by the side rails 25, but when it is desired to move the needlework A so that another portion thereof is supported for working engagement, the wing nuts 31 are loosened, and the dowels 26 are rotated (by grasping of the portions 27 or by grasping the needlework A surrounding the dowels 26) until a new section of needlework is provided, whereupon the wing nuts 31 are again tightened down on the bolts 30. It will be seen that by provision of the means 32 it is possible to provide needlework of widely varying dimensions on the frame 12, it being necessary only to rotate sections of needlework around the dowels 26 into position when necessary.

Preferably, the needlework A is attached to the dowels 26 by cotton webbing 35 or the like. The cotton webbing 35 is attached to the dowels in strips by stapling. The ends of the needlework A are then either sewn or stapled to the webbing 35, and the dowels are rotated, taking up the needlework A, until the proper portion thereof is in position on the frame 12.

Each of the two distinct support brackets 16 of the lap stand 14 includes a base member 37, and a pair of support members 38, 39 extending from the base member 37 to define, with the base member 37, a triangularly shaped support bracket. The base member 37 of each lap stand support bracket 16 has a pair of elongated faces 40, 41 thereof, and one support member 38 is attached to one face 41 of the base member 37, while the other support member 39 is attached to the opposite face 40 of the base member 37. In this way, the ends of the support members 38, 39 to be disposed adjacent the side rail 25 may overlap each other rather than interfere with each other. Attachment of the support members 38, 39 to the base member 37 may be effected by bolt-wing nut assemblies 42. (If desired, the support bracket 16 may be constructed so that when the wing nuts of the assemblies 42 are loosened the support members 38, 39 may be collapsed with respect to the base member 37 and lie face-to-face therewith).

Figure 1B:
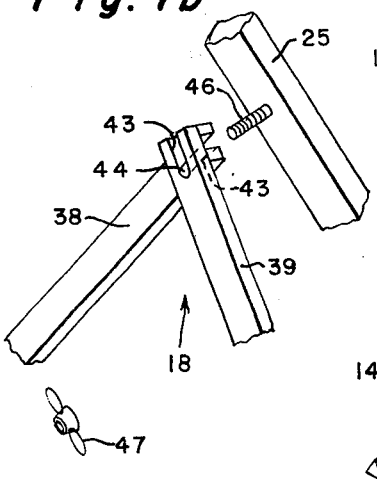
FIG. 1*b* is a detail exploded perspective view showing the inner connection between the needlework frame and the lap stand brackets of FIG. 1*a*.

The means 18 for pivotally mounting the needlework frame 12 on the lap stand 14 comprises a pivot-post 46 (see FIG. 1*b*) projecting outwardly from each side rail 25 of the needlework frame 12, and means defining pivot-post receiving slots 43 in each support member 38, 39 of each support bracket 16, each pivot-post 46 passing through the pivot-post receiving slots 43 in each support member 38, 39 when the lap stand 14 supports the frame 12. The slots 43 preferably extend to the terminal ends of the support members 38, 39, and when the support members 38, 39 are disposed in overlapping position (as shown in FIGS. 1*a* and 1*b*), there is an opening 44, to the slots 43 for receipt of the pivot-post 46. If desired a wing nut 47 may be provided (and the pivot-post 46 threaded) to hold the bracket 16 so that they do not become detached from the pivot-post 46 upon application of horizontal forces thereto. It is preferred, however, that the frame 12 remain freely pivotal with respect to the lap stand 14 (although the structure could be designed so that the wing nuts 47, when tightened on the bolts 46, hold the frame 12 in the particular pivotal position to which it has been moved with respect to the lap stand 14). The outwardly extending portion 27 of the dowels 26 may provide stops (by abutment of the support members 38, 39) for the pivotal movement of the frame 12 with respect to the lap stand 14.

When it is desired to support the needlework frame so that it is in a convenient workable position for someone in a standing or chair-sitting position rather than someone in a sitting position with legs outstretched, the floor stand 20 is utilized. The floor stand 20 comprises a pair of uprights 50, each upright connected to a base piece 51, and a spacer 52 operatively connecting the base pieces 51 and uprights 50 together. The means 18' for pivotally mounting the needlework frame 12 on the floor stand 20 so that the floor stand supports the needlework frame 12 yet the needlework frame is pivotal with respect thereto includes the bolts 46 and slots 54 formed in the terminal ends of the uprights 50 for receipt of the bolts 46. Again, the frame 12 and stand 20 may be freely pivotal with respect to each other (as indicated by arrows B) however, wing nuts 47 may be provided for latching the frame 12 in a particular pivotal position with respect to the floor stand 20.

The means 22 for mounting all the component parts of the lap stand 14 on the floor stand 20, when the lap stand 14 is not in use for supporting the needlework frame 12 includes a bolt 56 extending outwardly from each of the uprights 50, and the slots 43 (with open position 44) formed in the ends of support members 38, 39 of each support bracket 16 for receipt of the bolts 56. The bolts 56 are mounted a given distance H (see FIG. 2) on uprights 50 above the base members 51 so that when posts 56 are received by post receiving slots 43 of the lap stand support members 38, 39 the lap stand support bracket base members 37 are substantially vertically even with the floor stand base members 51. In fact, the posts 56 may be positioned so that the lap stand support brackets 16 provide additional support for the uprights 50 when the floor stand 20 is being utilized. Again, wing nuts may be provided on the ends of the posts 56 to hold the lap stand support brackets 16 thereon if desired.

It will thus be seen that according to the present invention an assembly for supporting needlework has been provided that is readily convertible from a lap position to a floor position, securely supports needlework in a taut working position while only one needlework frame need be provided for supported needlework of widely varying dimensions, a minimum number of component parts are provided, and all of the component parts of the lap stand are supported by the floor stand when the lap stand is not in use. While the invention has been herein shown and described in what is presently conceived to be the most preferred and practical embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. As assembly for supporting needlework comprising a. a needlework frame comprising a pair of side rails and a pair of dowels extending between said side rails and parallel to and spaced from each other, b. a lap stand for supporting said needlework frame so that it is in a convenient workable position for someone in a sitting position with legs outstretched, said lap stand including a pair of distinct support brackets, each support bracket including a base member and a pair of support members extending upwardly from said base member to define, with said base member, a triangularly shaped support bracket, said base member of each of said lap stand supports having a pair of elongated faces thereof, and each support member of each support bracket being attached to an opposite face of said base member from the other support member of the support bracket, c. means for pivotally mounting said needlework frame on said lap stand so that said lap stand supports said needlework frame yet the needlework frame is pivotal with respect thereto, said means comprising a slot formed at the end of each support member of each of said lap stand support brackets, said slots having an overlapping area providing an opening when defining a triangularly shaped support bracket, a bolt attached to said needlework frame and passing through each said opening formed by said slots in each of said support brackets, and a wingnut in operative association with each said bolt for releasably holding said support brackets to said needlework frame when tightened onto each of said bolts.

2. An assembly as recited in claim 1 wherein each of said dowels of said needlework frame has a strip of webbing attached thereto, said webbing adapted to receive needlework to be supported by said needlework frame.

3. An assembly as recited in claim 2 wherein said means for pivotally mounting said needlework frame on said lap stand comprises a pivot-post projecting outwardly from each side rail of said needlework frame, and means defining pivot-post receiving slots in each support member of each support bracket, each pivot-post passing through the pivot post receiving slots in each support member.

4. An assembly as recited in claim 1 further comprising means for mounting said dowels of said needlework frame with respect to said side rails thereof so that said dowels selectively are rotatable with respect to said side rails or non-rotatable with respect to said side rails

5. An assembly for supporting needlework comprising a. a needlework frame comprising a pair of side rails and a pair of dowels extending between said side rails and parallel to and spaced from each other, b. a floor stand for supporting said needlework frame so that it is in a convenient workable position for someone in a standing or chair-sitting position, said floor stand comprising a pair of uprights, each upright connected to a base piece, and a spacer operatively connecting said base piece together, c. means for pivotally mounting said needlework frame on said floor stand so that said floor stand supports said needlework frame yet the needlework frame is pivotal with respect thereto, d. a lap stand for supporting said needlework frame in place of said floor stand when positioning of said needlework frame in a convenient workable position for someone in a sitting position with their legs outstretched is desired, and e. means for mounting all component parts of said lap stand on said floor stand when said lap stand is not in use for supporting said needlework frame and while said floor stand supports said needlework frame.

6. An assembly as recited in claim 5 wherein said lap stand includes a pair of distinct support brackets, each support bracket including a base member and a pair of support members extending upwardly from said member to define, with said base member, a triangularly shaped support bracket.

7. An assembly as recited in claim 6 wherein said means for mounting said lap stand on said floor stand when said lap stand is not in use for supporting said needlework frame includes a post projecting outwardly from each upright of said floor stand, and means defining post receiving slots in each of said support members of each support bracket, each post passing through the post receiving slots in each support member, said posts being mounted a given distance on said uprights spaced from said floor stand base members so that when said posts are received by said post-receiving slots said lap stand support bracket base members are substantially vertically even with said floor stand base members.

8. An assembly as recited in claim 5 wherein said means for pivotally mounting said needlework frame on said floor stand comprises a means for mounting said needlework frame either on said floor stand or said lap stand for free, unrestricted pivotal movement.

9. An assembly as recited in claim 5 wherein each of said dowels of said needlework frame has a strip of webbing attached thereto, said webbing adapted to receive needlework to be supported by said needlework frame.

* * * * *